US005683742A

United States Patent [19]

Herbert et al.

[11] Patent Number: 5,683,742

[45] Date of Patent: Nov. 4, 1997

[54] SELECTIVE COATING METHOD USING A NONWETTING MATERIAL

[75] Inventors: William G. Herbert, Williamson; Ernest F. Matyi, Webster; Gary J. Maier, Webster; Monroe J. Hordon, Pittsford, all of N.Y.

[73] Assignee: Xerox Corporation, Stamford

[21] Appl. No.: 671,015

[22] Filed: Jun. 19, 1996

Related U.S. Application Data

[63] Continuation of Ser. No. 444,801, May 19, 1995, abandoned.

[51] Int. Cl.[6] ..... B05D 1/18; B05D 5/12; B05D 1/32; B05D 1/38

[52] U.S. Cl. ..... 427/11; 427/75; 427/231; 427/258; 427/430.1; 427/282

[58] Field of Search ..... 427/11, 74, 75, 427/181, 202, 231, 258, 282, 284, 300, 430.1

[56] References Cited

U.S. PATENT DOCUMENTS

| | | | |
|---|---|---|---|
| Re. 28,693 | 1/1976 | Doi et al. | 346/74 ES |
| 2,898,241 | 8/1959 | Charlton et al. | 427/282 |
| 4,125,647 | 11/1978 | Goto et al. | 427/300 |
| 4,351,862 | 2/1982 | Cosse et al. | 427/300 |
| 4,741,918 | 5/1988 | de Nagybaczon et al. | 427/11 |
| 5,156,780 | 10/1992 | Kenigsberg et al. | 264/22 |

*Primary Examiner*—Shrive Beck
*Assistant Examiner*—Fred J. Parker

[57] ABSTRACT

There is disclosed a coating method for a substrate having an end region comprising: (a) rubbing a nonwetting material across the end region to adhere the nonwetting material to the end region; and (b) contacting a portion of the substrate including the end region with a coating composition, whereby the coating composition adheres to the substrate surface free of the nonwetting material and the nonwetting material minimizes adherence of the coating composition to the end region.

9 Claims, No Drawings

SELECTIVE COATING METHOD USING A NONWETTING MATERIAL

This is a continuation of application Ser. No. 08/444,801, filed May 19, 1995 abandoned.

This invention relates generally to a coating method wherein the bottom end region of a substrate is treated with a nonwetting material. More particularly, the present invention pertains to a coating method comprising rubbing a nonwetting material across one end region of a hollow, cylindrical substrate to form a layer of the nonwetting material on the end region.

In electrophotography, and particularly in xerographic copying machines, coated substrates such as photoreceptor belts or cylindrical photoreceptor drums are common. Photoreceptor embodiments include at least one coating of photoconductive material, which can be formed on the photoreceptor by known techniques such as immersion or dip coating.

The end regions of a coated photoreceptor are used to engage with flanges in a printer's or copier's drive mechanism and/or to support a developer housing. If the developer housing rides on the coated area at one end region of the drum, the coating composition is rubbed off and contaminates various components in the machine such as the cleaning system and any optical exposure systems employed in the machine. Also, the coating can interfere with devices that are designed to electrically ground the drum by merely riding on the outer surface at one end region of the drum. Thus, both the outer and inner end regions of a photoreceptor generally must be free of the coating composition.

In dip coating, the upper end region of the photoreceptor drum might be kept free of coating composition by orienting the drum vertically and dipping the drum into a bath of coating composition to a predetermined depth which avoids coating the upper end region. However, the coating formed over the lower region end of the photoreceptor must still be removed such as by mechanically or manually wiping the lower end region and/or by applying solvents to it. This removal procedure is problematic since it may employ environmentally harmful solvents. Also, the coating removal procedure may require the use and maintenance of special equipment in the clean room which increase activity in the clean room, thereby decreasing productivity. In addition, the coating removal procedure is typically carried out in the clean room which increases costs since the procedure must meet clean room requirements. Alternatively, the end regions of the photoreceptor drums may be masked to prevent coating of the end regions. However, the mask must be removed from the photoreceptor drum subsequent to the dip coating process which is disadvantageous since this involves an additional step. Consequently, there is a need, which the instant invention addresses, for a coating method which eliminates or minimizes the above-identified problems.

The following patents may be relevant: Nagy de Nagybaczon et al., U.S. Pat. No. 4,741,918, Cosse et al., U.S. Pat. No. 4,351,862, and Doi et al., U.S. Pat. No. Re. 28,693.

SUMMARY OF THE INVENTION

It is an object of the invention to provide a coating method which minimizes or eliminates the need to remove coating composition from the bottom end region of a photoreceptor during its fabrication.

These objects and others are accomplished in embodiments by providing a coating method for a substrate having an end region comprising:

(a) rubbing a nonwetting material across the end region to adhere the nonwetting material to the end region; and (b) contacting a portion of the substrate including the end region with a coating composition, whereby the coating composition adheres to the substrate surface free of the nonwetting material and the nonwetting material minimizes adherence of the coating composition to the end region.

There is also provided in embodiments of the instant invention a coating method for a hollow cylindrically-shaped substrate defining a center region between a first end region and a second end region comprising:

(a) rubbing a nonwetting material across the first end region to adhere the nonwetting material to the first end region; and (b) contacting the center region and the first end region with a coating composition, whereby the coating composition adheres to the center region which is free of the nonwetting material and the nonwetting material minimizes adherence of the coating composition to the first end region.

DETAILED DESCRIPTION

The discussion herein of the instant invention will primarily involve a hollow, cylindrically-shaped substrate having open ends and defining a center region between a first end region and a second end region. The precise dimensions of the substrate's center region, first end region, and second end region may vary in embodiments. For an electrostatographic imaging member such as a photoreceptor, the outside surface of the center region corresponds to the imaging area and the outside surfaces of the first end region and the second end region correspond to the non-imaging areas. In embodiments of the instant invention, the first end region has a width, as measured from an end edge towards the center region, ranging in size from about 1 cm to about 20 cm, preferably from about 5 cm to about 15 cm, and especially about 10 cm. The second end region may have the same or similar dimension as the first end region. However, the instant invention is not limited to such a hollow, cylindrically-shaped substrate and other suitable configurations as discussed herein can be employed.

A substrate is prepared for the coating of for example a photoconductive material by employing a number of preparatory steps including the following illustrative steps. The substrate can be cut to the desired length by using for instance a chamfering machine. In embodiments of the instant invention, the nonwetting material may be rubbed against the inner surface of the first end region and optionally the inner surface of the second end region. It may be desirable in some embodiments to apply the nonwetting material also on a portion of the inner surface of the substrate's center region or even to apply the nonwetting material over the entire inner surface of the substrate. Subsequent to the optional application of the nonwetting material on the inner surface of the substrate, the substrate may be mounted and rotated on a lathe and the outer substrate surface may be diamond turned using a diamond tipped cutting tool to produce the desired finish. The lathing fluid and the resulting debris may be removed in a cleaning step. Subsequent to the cleaning step, the nonwetting material is rubbed onto the outer surface of the first end region, preferably to coat the entire outer surface of the first end region, and optionally onto the outer surface of the second end region. There may be other conventional substrate preparatory steps not specifically discussed herein, but such steps are encompassed within embodiments of the instant invention. In embodiments of the instant invention, the nonwetting material may be applied to the outer and inner surfaces of the first end region of the substrate subsequent to the chamfering, lathing and cleaning steps.

The nonwetting material is rubbed across the surface of the substrate by using for example an applicator having a resilient surface which is in sliding contact with the substrate. The applicator itself may be fabricated from the nonwetting material wherein the applicator may be in the configuration for example of a stick, a pad, a rod, or a bar.

In embodiments of the instant invention, the nonwetting material may be applied by placing particles of the nonwetting material onto an applicator which may be in the configuration for example of a roll, a wheel, a pad, a brush, or the like, and rubbing the applicator against the substrate surface. The applicator may be fabricated from for example cotton fibers, felt, or synthetic fibers such as polyester. One type of applicator for use in the method of the invention is a jeweler's buffing wheel. Suitable buffing wheels include those available from W. Canning Materials Limited, Great Hampton Street, Birmingham, England. These buffing wheels generally comprise a plurality of fabric discs clamped together in a way which allow the density of fabric at the periphery of the wheel to be adjusted. The applicator may be made from sheets of high purity cotton fabric cut into discs. A number of these discs, such as 12, are layered so that every other disc has its weave at an angle of 45 degrees to each other. The layers are then placed in a two piece mold specially designed to allow low viscosity epoxy to be injected, which results in a hub made up of cotton reinforced epoxy. The hub diameter is less than the diameter of the discs thereby allowing the discs to have for example 2.5 cm in length of free fibers. The applicator can also include other layers of material to reinforce the applicator enabling it to withstand the high speeds of rotation. Material such as KEVLAR™ or graphite, preferably 3 layers of KEVLAR™ distributed uniformly among the cotton layers, are included in the composition of the applicator.

The particles of nonwetting material may be delivered to the surface of the applicator in the dry state, for example in a gas stream. It may be possible in embodiments to deliver the particles to the surface of the applicator in the form of a liquid dispersion, such dispersions being readily controllable. Preferably, the dispersing liquid is sufficiently volatile to evaporate almost instantly, leaving the particles in a substantially dry state. A suitable dispersing liquid is trichlorotrifluoroethane, though other low-boiling halogenated hydrocarbons can also be used, as can other liquids such as water.

The rubbing of the nonwetting material across the surface of the substrate may take place using a wide range of process conditions, which are all dependent on each other. Thus, when the applicator is in the form of for example a wheel which is used to rub particles of nonwetting material across the substrate, the pressure applied by the wheel, the area of contact between the wheel and the substrate, the peripheral speed of the wheel, and the relative speed between the surface of the wheel and the substrate may all be varied. However, alteration of any one of these parameters may require that one or more of the other parameters be adjusted in order to compensate. In addition, of course, the conditions which are appropriate for applying the nonwetting material to a given substrate may not be appropriate for a different substrate or for a different nonwetting material. In all cases, however, the appropriate process conditions will be readily determinable by the person skilled in the art.

The substrate, the applicator, or both may be rotating during application or rubbing of the nonwetting material against the substrate. Preferably, the substrate and the applicator are rotating or moving in opposite directions. The substrate may be rotating at a speed ranging for example from about 200 to about 4,000 rpm, preferably from about 300 to about 3,000 rpm, and especially about 2,000 rpm. The applicator may be spinning at a surface speed ranging for example from about 100 fps (feet per second) to about 1,000 fps, preferably from about 400 fps to about 800 fps, and especially about 700 fps. In embodiments, the substrate may be stationary while the applicator may be moving to apply the nonwetting material.

Generally, the more delicate the substrate, the lower the pressure with which the particles of nonwetting material should be pressed against the substrate, in order to avoid damage thereto. Thus, for less robust substrates, the pressure with which the applicator bears against the substrate may be very low, for example from less than about 1 g/cm$^2$ to a few grams/cm$^2$. When relatively sturdy substrates are used, it may be appropriate to use still larger contact pressures between the applicator and the substrate. For example, pressures greater than about 1 kg/cm$^2$ may be appropriate for rubbing a substrate fabricated from a metal with other relatively hard materials (such as metals, metal oxides, and the like). Dynamic pressures of from about 2 to about 100 kg/cm$^2$, preferably from about 5 to about 50 kg/cm$^2$, may be used.

It is preferred that the nonwetting material is rubbed across the substrate surface, such as the first end region, which is bare of any layered material, i.e., there is no coating composition present on the substrate surface to prevent contact of the nonwetting material with the substrate surface.

The particles of the nonwetting material may form a preferably continuous layer on the substrate, wherein the nonwetting material may be highly adherent to the substrate surface and may be substantially free of voids. The layer of the nonwetting material is preferably substantially uniform in thickness, wherein the nonwetting material layer may have a thickness ranging for example from about 5 nanometers to about 5 microns, and preferably from about 50 nanometers to about 3 microns.

Additional details of an illustrative process to coat particulate material onto a substrate are provided in Nagy de Nagybaczon et al., U.S. Pat. No. 4,741,918, the disclosure of which is totally incorporated by reference.

The nonwetting material can be selected from an enormous variety of materials. For example, it may be an organic polymer. Illustrative examples include: polyolefins such as polyethylene, polypropylene, polybutylene and copolymers of the foregoing; halogenated polyolefins such as fluorocarbon polymers like polytetrafluoroethylene and fluorinated ethylene-propylene; polyesters such as polyethyleneterephthalate; vinyl polymers such as polyvinylchloride and polyvinyl alcohol; acrylic polymers such as polymethylmethacrylate and polyethylmethacrylate; and polyurethanes. Preferred organic nonwetting material are paraffin, beeswax, polyolefin, and SCOTCHGARD™ fabric repellent aerosol spray comprised of isoparaffinic hydrocarbon, carbon dioxide, and fluoroaliphatic resin, available from 3M Company. Alternatively, the nonwetting material may be a metal such as gold, silver, platinum, iron, aluminium, chromium or tantalum. Further examples of suitable nonwetting materials include zinc stearate, magnetic oxides such as magnetic iron oxide and magnetic chromium dioxide, minerals such as quartz, organic and inorganic pigments, and even such materials as diamond and china clay. Yet, further examples include metalloid elements such as phosphorus, silicon, germanium, gallium, selenium and arsenic, optionally doped with other materials to confer semiconductor properties. If desired, mixtures of different kinds of nonwetting materials may also be used. Preferably, the nonwetting material is selected so that it will not dissolve in any solvent present in the coating solution for the coating composition.

The particles of the nonwetting material will generally be less than 100 microns in size. However, the most appropriate particle size will depend to some extent on the chemical nature of the nonwetting material and on the physical and chemical nature of the substrate. Usually, the particles of the nonwetting material will have a maximum diameter of less than 50 microns and more usually a maximum diameter less than 30 microns. For example, the particles may have a maximum diameter of from 0.5 to 30 microns, such as from 1 to 10 microns.

Subsequent to the application of the nonwetting material, a coating composition is applied to a portion of the substrate including the center region and the first end region, and optionally the second end region. The coating composition adheres to the outside surface of the center region since it is free of the nonwetting material, and the first end region is substantially or totally free of the coating composition, on preferably both the outer surface and inner surface of the first end region, since the nonwetting material minimizes or eliminates adherence of the coating composition to the first end region. The presence of the nonwetting material on the substrate reduces the surface tension, thereby minimizing or eliminating adherence of the coating composition to the substrate regions covered with the nonwetting material. The coating composition may be applied by any conventional technique including for example dip coating, slot coating, and the like. In one embodiment, a portion of the substrate, such as the first end region and the center region, is lowered or immersed into a vessel containing the coating composition. The substrate is oriented vertically, with the first end region being the bottom end region. The substrate is then withdrawn from the vessel and the coating composition adheres to the portion of the substrate where the nonwetting material is absent. The substrate may be withdrawn from the coating composition at a rate ranging for example from about 1 mm/second to about 1 cm/second, and preferably ranging from about 5 mm/second to about 8 mn/second. The coating is dried in a conventional manner such as by blowing air against the coating composition. A plurality of coatings in succession may be deposited on the substrate.

The instant invention in embodiments may provide a number of advantages. For example, there is no need to remove the nonwetting material subsequent to application of the coating composition, thereby avoiding a coating removal step. Also, application of the nonwetting material can occur outside the clean room, thereby minimizing expense. In addition, application of the nonwetting material avoids the use of environmentally harmful solvents that are employed in the conventional bottom edge wipe procedure to remove the coating composition from the first end region, i.e., the bottom end region.

The coating composition may include layered materials which are employed in the fabrication of for instance magnetic recording media and electrical components having conducting resistive, dielectric or semiconducting layers thereon. Other applications include the formation of protective coatings, decorative coatings, sizing coatings, key coats, light or heat absorbing coatings, light or heat reflective coatings, heat conducting coatings, slip coatings, non-slip coatings, anti-corrosion coatings, anti-static coatings and even abrasive coatings on substances such as metal, paper, glass, ceramics, fabrics and plastics.

The coating composition or coating compositions to be applied preferably are materials typically employed in the fabrication of an electrostatographic imaging member, especially in the fabrication of a photoreceptor. A description of suitable materials for the coatings and of suitable materials for the supporting substrate follows.

The Supporting Substrate

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate may be flexible, semi-rigid, or rigid, and may have any number of different configurations such as, for example, a sheet, a scroll, an endless flexible belt, a cylinder, and the like. The substrate may be in the form of an endless flexible belt which comprises a commercially available biaxially oriented polyester known as MYLAR™, available from E. I. du Pont de Nemours & Co., or MELINEX™, available from ICI Americas Inc.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment, and the like.

The Electrically Conductive Ground Plane

The electrically conductive ground plane may be an electrically conductive metal layer which may be formed, for example, on the substrate by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission. Regardless of the technique employed to form the metal layer, a thin layer of metal oxide may form on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Blocking Layer

After deposition of the electrically conductive ground plane layer, the blocking layer may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, gamma-aminobutyl) methyl diethoxysilane, and $[H_2N(CH_2)_3]CH_3Si(OCH_3)_2$, (gamma-aminopropyl)-methyl diethoxysilane, as disclosed in U.S. Pat. Nos. 4,338,387, 4,286,033 and 4,291,110. Other suitable hole blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is the 30 mole percent benzoate ester of poly(2-hydroxyethyl methacrylate) blended with the parent polymer poly(2-hydroxyethyl methacrylate). Still other suitable hole blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of U.S. Pat. Nos. 5,244,762 and 4,988,597 are incorporated herein by reference in their entirety.

The blocking layer is continuous and may have a thickness of less than about 10 micrometers because greater thicknesses may lead to undesirably high residual voltage. A hole blocking layer of between about 0.005 micrometer and about 1.5 micrometers is preferred because charge neutralization after the exposure step is facilitated and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 5:100 is satisfactory for spray coating.

The Adhesive Layer

Intermediate layers between the blocking layer and the adjacent charge generating or photogenerating layer may be desired to promote adhesion. For example, the adhesive layer may be employed. If such layers are utilized, they preferably have a dry thickness between about 0.001 micrometer to about 0.2 micrometer. Typical adhesive layers include film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like.

The Imaging Layer(s)

The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating overcoated with a charge transport layer. The photoconductive layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound are dispersed in an electrically insulating organic resin binder. The entire disclosure of this patent is incorporated herein by reference. Other well known electrophotographic Imaging layers include amorphous selenium, halogen doped amorphous selenium, amorphous selenium alloys including selenium-arsenic, selenium-tellurium, selenium-arsenic-antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, a charge generating layer and a charge transport layer.

Any suitable charge generating or photogenerating material may be employed as one of the two electrically operative layers in the multilayer photoconductor embodiment of this invention. Typical charge generating materials include metal free phthalocyanine described in U.S. Pat. No. 3,357,989, metal phthalocyanines such as copper phthalocyanine, vanadyl phthalocyanine, selenium containing materials such as trigonal selenium, bisazo compounds, quinacridones, substituted 2,4-diaminotriazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generating layers are disclosed in U.S. Pat. No. 4,265,990, U.S. Pat. No. 4,233,384, U.S. Pat. No. 4,471,041, U.S. Pat. No. 4,489,143, U.S. Pat. No. 4,507,480, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein by reference in their entirety.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like. Many organic resinous binders are disclosed, for example, in U.S. Pat. No. 3,121,006 and U.S. Pat. No. 4,439,507, the disclosures of which are totally incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present for example in an amount of at least about 15 percent by volume of the binder layer with no limit on the maximum amount of photoconductor in the binder layer. If the matrix or binder comprises an active material, e.g. poly-N-vinylcarbazole, the photoconductive material need only to comprise for example about 1 percent or less by volume of the binder layer with no limitation on the maximum amount of photoconductor in the binder layer. Generally for charge generator layers containing an electrically active matrix or binder such as poly-N-vinyl carbazole or phenoxy [poly (hydroxyether)], from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder The specific proportions selected also depends to some extent on the thickness of the generating layer.

The thickness of the photogenerating binder layer is not particularly critical. Layer thicknesses from about 0.05 micrometer to about 40.0 micrometers may be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generating layer. The active transport layer is normally transparent when exposure is effected through the active layer to ensure that most of the incident radiation is utilized by the underlying charge generating layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generating layer is a material which is an insulator to the extent that an electrostatic charge placed on the transport layer is not conductive in the absence of illumination, i.e., does not discharge at a rate sufficient to prevent the formation and retention of an electrostatic latent image thereon.

An especially preferred transport layer employed in one of the two electrically operative layers in the multilayer photoconductor embodiment of this invention comprises from about 25 to about 75 percent by weight of at least one charge transporting aromatic amine compound, and about 75 to about 25 percent by weight of a polymeric film forming resin in which the aromatic amine is soluble.

Examples of charge transporting aromatic amines for charge transport layers capable of supporting the injection of photogenerated holes of a charge generating layer and transporting the holes through the charge transport layer include triphenylmethane, bis(4-diethylamine-2-methylphenyl) phenylmethane; 4.'-4"-bis(diethylamino)-2', 2"-dimethyltriphenyl-methane, N,N'-bis(alkylphenyl)-[1,1'-biphenyl]-4,4'-diamine wherein the alkyl is, for example, methyl, ethyl, propyl, n-butyl, and the like, N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'diamine, and the like dispersed in an inactive resin binder.

Any suitable inactive resin binder soluble in methylene chloride or other suitable solvent may be employed. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as LEXAN 145™ from General Electric Company; poly(4,4'-isopropylidene-diphenylene carbonate) with a molecular weight of from about 40,000 to about 45,000, available as LEXAN 141™ from the General Electric Company; a polycarbonate resin having a molecular weight of from about 50,000 to about 100,000, available as MAKROLON™ from Farbenfabricken Bayer A. G., a polycarbonate resin having a molecular weight of from about 20,000 to about 50,000 available as MERLON™ from Mobay Chemical Company and poly(4,4'-diphenyl-1,1-cyclohexane carbonate). Methylene chloride solvent is a particularly desirable component of the charge transport layer coating mixture for adequate dissolving of all the components and for its low boiling point. However, the type of solvent selected depends on the specific resin binder utilized.

If desired, the charge transport layer may comprise any suitable electrically active charge transport polymer instead of a charge transport monomer dissolved or dispersed in an electrically inactive binder. Electrically active charge transport polymer employed as charge transport layers are described, for example in U.S. Pat. Nos. 4,806,443; 4,806,444; and 4,818,650, the disclosures thereof being totally incorporated herein by reference.

Any suitable and conventional technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the transport layer is between about 5 micrometers to about 100 micrometers, but thicknesses outside this range can also be used. In general, the ratio of the thickness of the charge transport layer to the charge generating layer is preferably maintained from about 2:1 to 200:1 and in some instances as great as 400:1.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

A specimen dish was filled to a depth of about 9.5 mm with room temperature water. SCOTCHGARD™ was sprayed onto the surface of the water until a film was observed on the water surface. The bottom end of a clean, cylindrical, aluminum substrate was dipped through the film into the water to the bottom of the dish and pulled immediately out. At least a monolayer of the SCOTCHGARD™ (nonwetting material) was deposited on the bottom 9.25 mm length of the substrate. After air drying, the substrate was dip coated into each of the following coating solutions to form a layered imaging member: (1) an undercoat layer coating solution of nylon 8 dispersed in isopropanol solvent; (2) a charge generating layer coating solution of dibromoanthanthrone, polyvinyl butyral, and cyclohexanone solvent; and (3) a charge transport layer coating solution of polycarbonate, N,N'-diphenyl-N,N'-bis(3-methylphenyl)-[1,1'-biphenyl]-4,4'diamine, and methylene chloride solvent. No bottom edge wipe procedure was employed after each dip coating. Each layer after deposition on the substrate was oven dried. The resulting imaging member is free of the three coating layers on the bottom 9.25 mm of the member.

EXAMPLE 2

A substrate similar to the substrate of Example 1 was exposed to a rotating cotton polishing wheel which was impregnated with polytetrafluoroethylene ("TFE") powder. The cotton polishing wheel was 100 mm in diameter and was rotated at 1200 rpm. The bottom 9.5 mm of the substrate was coated with at least a monolayer of TFE (nonwetting material), which was rubbed onto the substrate using the polishing wheel. The substrate was dip coated into the same three coating solutions of Example 1 to form the imaging member. No bottom edge wipe procedure was employed after each dip coating. Each layer after deposition on the substrate was oven dried. The resulting imaging member is free of the three coating layers on the bottom 9.5 mm of the member.

EXAMPLE 3

The same procedure of Example 2 were carried out except that the cotton polishing wheel was impregnated with TFE by rubbing the wheel over a solid bar of TFE for 30 seconds. The resulting imaging member is free of the three coating layers on the bottom 9.5 mm of the member.

EXAMPLE 4

The same procedures of Example 2 were carried out except that the cotton polishing wheel was impregnated with a nonwetting material of low density polyethylene (also referred to as conventional polyethylene) which is a lower molecular weight polyolefin. The resulting imaging member is free of the three coating layers on the bottom 9.5 mm of the member.

Other modifications of the present invention may occur to those skilled in the art based upon a reading of the present disclosure and these modifications are intended to be included within the scope of the present invention.

We claim:

1. A coating method for fabricating a photosensitive member including a hollow cylindrically-shaped substrate defining a center region between a first end region and a second end region comprising:

(a) adhering a nonwetting material to the first end region; and (b) sequentially dip coating the center region and the first end region in at least two coating compositions comprising materials for different layers of the photosensitive member wherein the nonwetting material fails to dissolve in each of the at least two coating compositions, wherein each of the at least two coating compositions adheres to the center region which is free of the nonwetting material and the nonwetting material minimizes adherence of each of the at least two coating compositions to the first end region, wherein there is absent a step subsequent to (b) of removing the nonwetting material from the first end region.

2. The method of claim 1, wherein the first end region has an outer surface and an inner surface, and (a) comprises rubbing the nonwetting material on the outer surface and the inner surface of the first end region.

3. The method of claim 1, wherein (a) comprises rubbing the nonwetting material on the first end region, thereby forming a layer of the nonwetting material on the first end region.

4. The method of claim 1, wherein the nonwetting material is selected from the group consisting of polytetrafluoroethylene, fluorinated ethylenepropylene and zinc stearate.

5. The method of claim 1, wherein the nonwetting material is selected from the group consisting of paraffin, beeswax, polyolefin, diamond, and metal.

6. The method of claim 1, wherein (a) comprises rubbing an applicator against the first end region, wherein particles of the nonwetting material are present on the surface of the applicator.

7. The method of claim 1, wherein (a) comprises rubbing an applicator fabricated from the nonwetting material against the first end region.

8. The method of claim 1, wherein (b) comprises contacting the center region and the first end region with each of the at least two coating compositions, wherein the first end region is free of the coating compositions since each of the at least two coating compositions fails to adhere to the nonwetting material on the first end region.

9. The method of claim 1, wherein (b) comprises dip coating the center region and the first end region in three coating compositions.

* * * * *